US006884179B2

(12) United States Patent
Hoffman et al.

(10) Patent No.: US 6,884,179 B2
(45) Date of Patent: Apr. 26, 2005

(54) GOLF CLUB AND METHOD FOR MAKING IT

(75) Inventors: Joseph H. Hoffman, Carlsbad, CA (US); Stephen A. Kraus, San Diego, CA (US); Michael Scott Burnett, Carlsbad, CA (US); Chris Mason, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 475 days.

(21) Appl. No.: 09/881,361

(22) Filed: Jun. 13, 2001

(65) Prior Publication Data

US 2003/0004009 A1 Jan. 2, 2003

(51) Int. Cl.[7] ..... A63B 53/02
(52) U.S. Cl. ..... 473/312; 473/345
(58) Field of Search ..... 413/312; 473/345, 473/346, 350

(56) References Cited

U.S. PATENT DOCUMENTS

| | | | | |
|---|---|---|---|---|
| 3,625,513 A | | 12/1971 | Ballmer | 273/80.5 |
| 4,220,336 A | | 9/1980 | Kochevar | 273/80.8 |
| 4,607,846 A | | 8/1986 | Perkins | |
| 4,667,963 A | * | 5/1987 | Yoneyama | |
| 5,205,552 A | | 4/1993 | Green, Jr. | |
| 5,205,553 A | | 4/1993 | Okumoto et al. | 273/80.8 |
| 5,261,669 A | | 11/1993 | Kochevar | 273/169 |
| 5,263,713 A | | 11/1993 | Taylor et al. | 273/78 |
| 5,348,302 A | * | 9/1994 | Sasamoto | |
| 5,374,062 A | | 12/1994 | Kochevar | 273/169 |
| 5,452,890 A | * | 9/1995 | Bingman | |
| 5,709,614 A | | 1/1998 | Horiba | 473/305 |
| 5,888,148 A | * | 3/1999 | Allen | |
| 6,102,274 A | | 8/2000 | Nagamoto | 228/114.5 |

FOREIGN PATENT DOCUMENTS

| | | |
|---|---|---|
| JP | 08-206257 | 8/1996 |
| JP | 09-070454 | 3/1997 |
| JP | 09-248355 | 9/1997 |
| JP | 2000-005350 | 1/2000 |
| JP | 2000-084123 | 3/2000 |
| JP | 2001-054597 | 2/2001 |
| JP | 2001-112893 | 4/2001 |
| JP | 2001-129131 | 5/2001 |
| JP | 2001-161865 | 6/2001 |
| WO | WO 00/62873 | 10/2000 |

OTHER PUBLICATIONS

"Tour Cavity Irons," *Golfsmith Clubmaking Catalog 2001*, p. 38.

* cited by examiner

*Primary Examiner*—Stephen Blau
(74) *Attorney, Agent, or Firm*—Sheppard, Mullin, Richter & Hampton LLP

(57) ABSTRACT

An improved golf club is disclosed, in which a desired weight for the club's head is precisely controlled by installing into a hosel cavity a selected hosel plug from a group of such plugs having identical sizes but a range of weights. After the selected hosel plug has been installed, the shaft is inserted into an upper portion of the hosel cavity, above the hosel plug. The plug is configured to have little effect on important club head parameters such as coefficient of restitution and center of gravity, and it also is configured to remain in its installed position even if the club's shaft is removed and replaced. The invention is applicable to golf clubs of all kinds, including metal woods, irons and putters.

19 Claims, 1 Drawing Sheet

GOLF CLUB AND METHOD FOR MAKING IT

BACKGROUND OF THE INVENTION

This invention relates generally to golf clubs and to methods for making them and, more particularly, to golf clubs and related methods in which the club head incorporates an added weight component to provide the head with a desired weight.

One important parameter of golf clubs is the weight of their heads. The weight of the head must be carefully controlled, not only to meet the particular needs of the individual golfer using the club, but also to combine with the golfer's other clubs to form a matched set. Golf club manufacturers, therefore, customarily weigh each club head during the manufacturing process and add one or more components of precise weight so as to adjust the club head's weight to a desired overall value.

The added components for adjusting the club head's weight have taken many different forms. One common form, which has been used with metal wood-type golf club heads, is a material such as epoxy that is added in selected amounts to the club head's hollow cavity. Although this use of epoxy has been generally effective in correcting for weight variances in golf club heads, negative side effects can result. For example, the epoxy can affix to the inner surface of the club head's ball-striking face, which can have adverse effects, such as lowering the face's coefficient of restitution. Also, pooling of the epoxy can displace the club's center of gravity, and can affect the club head's sound at ball impact, in an indeterminate way.

Another common form for the added weight component has been a metalic plug installed within the axial bore formed by the hollow shaft of the club, where it joins to the club head's hosel. Such shaft weight plugs also have been formed of alternative materials such as metallic powder dispersed within a compressible binder and housed within a sheath. Although generally effective in providing the club head with the desired weight, such shaft weight plugs sometimes can loosen and cause undesired rattling during the club's use. Also, if the need ever arises to replace the club's shaft, the shaft weight plug will necessarily be removed with the old shaft and an equivalent weight might not be installed in its place when the new shaft is attached to the club head.

It should therefore be appreciated that there is a need for an improved golf club head, and method for making it, in which the head's weight can be tailored to a precisely selected value, without adversely affecting important parameters such as the club head's coefficient of restitution or center of gravity, and without being susceptible to loosening during use or removal when the club's shaft is replaced. The present invention fulfills this need and provides further related advantages.

SUMMARY OF THE INVENTION

The present invention resides in an improved golf club, and in a method for making it, in which the weight of the club head is tailored to a precisely selected value without adversely affecting club head parameters such as coefficient of restitution or center of gravity, and without being susceptible to loosening during use or removal when the club's shaft is replaced. The golf club head has a heel, a toe, and a ball-striking face, with the heel including a hosel that defines a generally cylindrical cavity. A hosel plug, of selected weight, is installed into a lower portion of the hosel cavity, and a shaft is installed into an upper portion of the hosel cavity, at a location above the hosel plug. The hosel plug comprises a mixture of a metallic powder and a compliant polymeric material, in prescribed relative proportions, and it is sized to fit snugly into the lower portion of the hosel cavity, where it is secured in place by compression of its compliant polymeric material.

The hosel plug is selected from a plurality of hosel plugs, all having substantially the same size and shape, but each having a different proportion of the metallic powder and the compliant polymeric material so as to have a different weight. The particular hosel plug is selected so that its weight will provide the golf club head with the desired total weight.

In its preferred form, the group of hosel plugs range in mass from about 0.5 g to at least about 6.5 g. This constitutes from about 0.25% to at least about 3.25% of the club head's total weight. The metallic powder of each hosel plug preferably includes a dense metallic material such as tungsten, and the compliant polymeric material of the plug preferably includes a compressible polymeric material such as nylon. When these materials are used, the desired weight range can be provided by varying the weight proportion of tungsten between about 0% for the lightest plug and about 96% for the heaviest plug.

In one preferred form of the invention, the hosel cavity includes a lower cylindrical cavity having a first diameter and an upper cylindrical cavity having a second diameter, larger than the first diameter. The hosel plug has a substantially cylindrical shape sized to fit snugly within the hosel's lower cylindrical cavity, and the lower end of the shaft has a substantially cylindrical shape sized to fit within the hosel's upper cylindrical cavity. When the metallic material incorporated into the hosel plug is tungsten, the hosel's lower cylindrical cavity preferably has a diameter about 8.5 mm and a length of about 10 mm, and the hosel's upper cylindrical cavity preferably has a diameter of about 9 mm and a length of about 25 mm. Of course, if a metallic material other than tungsten is used, the preferred dimensions will change correspondingly.

Other features and advantages of the invention should become apparent from the following description of the preferred embodiment, taken in conjunction with the accompanying drawings, which illustrate, by way of example, the principles of the invention.

DESCRIPTION OF THE PREFERRED EMBODIMENT

Figure 1:
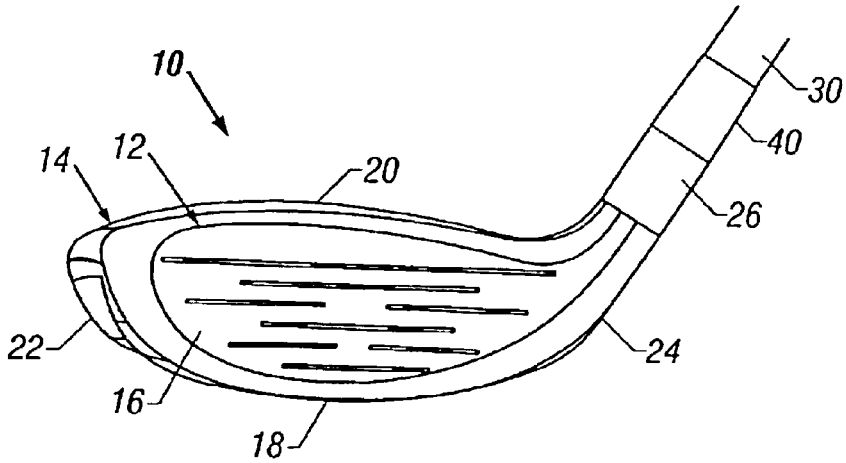
FIG. 1 is a front elevational view of a metal wood-type golf club constructed in accordance with the invention, showing the golf club's head and the lower portion of the golf club's shaft.
Figure 2:
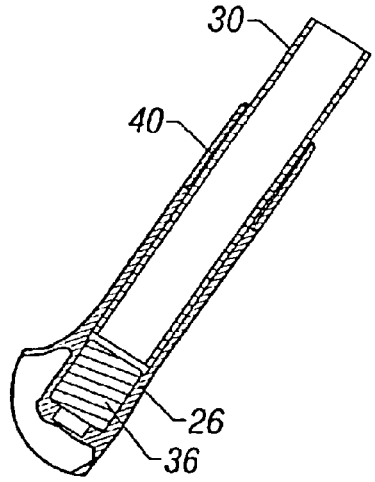
FIG. 2 is a fragmentary front sectional view of the golf club of FIG. 1, showing the golf club's hosel plug and shaft in their installed positions in the club head's hosel.
Figure 3:
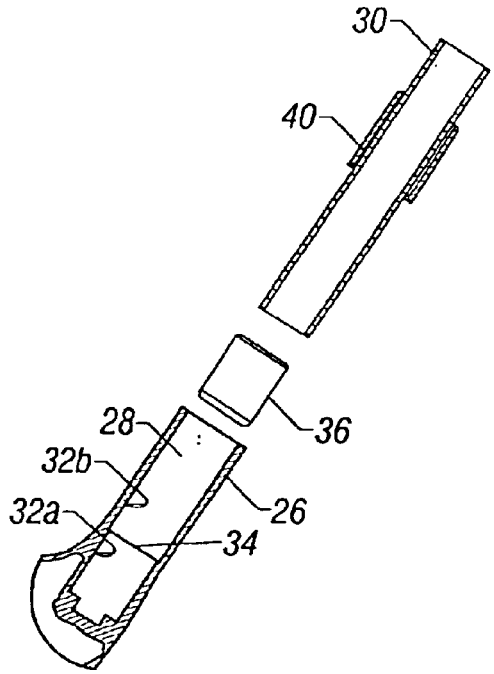
FIG. 3 is an exploded sectional view of the components of the golf club depicted in FIG. 2.

With reference now to the illustrative drawings, and particularly to FIGS. 1–3, there is shown a metal wood-type golf club 10 having a hollow club head 12 that is specially weighted to a desired value. The club head 12 is manufactured by any of a number of suitable techniques. For example, the club head 12 can include a main body 14 and a face plate 16, which are formed separately and then joined together by suitable means, such as welding. The main body 14 defines a sole 18, a crown 20, a toe 22, and a heel 24, which cooperate to define an opening sized to match the peripheral shape of the face plate 16. The main body 14 can be formed by any suitable means, such as casting, and the face plate 16 likewise can be formed by any suitable means, such as cold forming a rolled sheet.

A hosel 26 located at the heel 24 of the club heat's main body 14 defines an elongated cavity 28 for receiving the lower end of a shaft 30. This cavity 28 includes a lower cylindrical portion 32*a* and an aligned upper cylindrical portion 32*b*. An upward-facing annular ledge 34 thereby is defined between the lower and upper cylindrical portions 32*a*, 32*b*.

Before the shaft 30 is installed into the hosel cavity 28, the club head 12 is assembled by joining together the face plate 16 and the main body 14, e.g., by welding. At this time, manufacturing tolerances can cause the club head's weight to vary within a limited range. Generally, it is desired to adjust this variable weight to a more precise value, which is selected to match the needs of the particular golfer who will be using the club 10.

In accordance with the invention, the weight of the club head 12 is adjusted to the desired value by installing a special hosel plug 36 into the lower cylindrical portion 32*a* of the hosel cavity 28. The hosel plug 36 is selected from a group of several hosel plugs, which range in mass between the minimum and maximum values that might be required to bring the combined head/plug weight to the desired value. Typically, a suitable range of values will be from about 0.5 g to about 6.5 g. The particular hosel plug to be selected is determined simply by weighing the club head 12 and subtracting that value from the desired club head weight.

Figure 4:
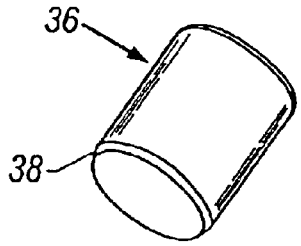
FIG. 4 is an enlarged perspective view of the hosel plug of the golf club of FIG. 1.

All of the hosel plugs 36 in the group of hosel plugs have substantially the same shape and dimensions, which preferably corresponds to the size of the lower cylindrical portion 32*a* of the hosel cavity 28. Such a hosel plug 36 is depicted in detail in FIG. 4. Different weights for the individual hosel plugs are provided by varying the plugs compositions.

Each hosel plug 36 preferably is formed of a mixture of a metallic powder and a compressible non-metallic material, in prescribed relative proportions. Preferably, the metallic powder is composed of a dense metal such as tungsten, and the compressible non-metallic material is composed of a compliant polymeric material such as nylon. The compliant polymeric material functions to hold the metallic powder particles together to form a cohesive unit.

A range of weights for the group of hosel plugs is provided by varying the relative proportions of the metallic powder and the compliant polymeric material in each. The lightest hosel plug can incorporate as little as 0% tungsten, and the heaviest hosel plug can incorporate as mach as 96% tungsten, with the balance in each case being nylon. By way of example, the combinations set forth in Table 1 can be provided.

TABLE 1

| Hosel Plug No. | Mass (g) | Density (g/cc) |
|---|---|---|
| 0 | 0.5 | 1.0 |
| 1 | 1.5 | 2.7 |
| 2 | 2.5 | 4.3 |
| 3 | 3.5 | 6.0 |
| 4 | 4.5 | 7.6 |
| 5 | 5.5 | 9.3 |
| 6 | 6.5 | 11.0 |

In use, the selected hosel plug 36 is installed into the club head 12 simply by inserting it into the cavity 28 of the hosel 26, where it fits snugly into the cavity's lower cylindrical portion 32*a*. A bevel 38 at the hosel plug's lower end facilitates this insertion. In the hosel plug's installed position, the compliant polymeric material is slightly compressed, to secure the hosel plug 36 in place by an interference fit. The upper end of the hosel plug 36 projects slightly above the ledge 34 defined between the cavity's lower and upper cylindrical portions 32*a* and 32*b*, respectively.

When the golf club 10 is constructed using hosel plugs 36 selected from the group of hosel plugs specified in Table 1, the hosel plugs are cylindrical, with a diameter of about 8.5 mm and a length of about 10.5 mm. In that case, the lower cylindrical portion 32*a* of the hosel cavity 28 has a diameter of 8.5 mm and a length of 10 mm, and the upper cylindrical portion 32*b* of the cavity has a diameter of 9.1 mm and a length of about 27 mm. Of course, if the hosel plug 36 incorporates a metallic material other than tungsten, e.g., iron, the preferred dimensions for the hosel plug 36 and for the lower and upper cylindrical portions 32*a*, 32*b* will change correspondingly. In an alternative configuration, the cavity's lower and upper cylindrical portions 32*a*,32*b* could have the same diameters.

After the selected hosel plug 36 has been installed into the hosel cavity 28, the shaft 30 is installed above it. The lower end of the shaft 30 is generally cylindrical, with a diameter that matches the diameter of the cavity's upper cylindrical portion 32*b*. Before installing the shaft 30, a ferrule 40 is attached to the shaft's lower end by an interference fit. The ferrule 40 is positioned such that about 25 mm of the shaft projects below a bottom portion of the ferrule. A suitable adhesive material, e.g., epoxy, then is injected into the hosel cavity 28, and the end of the lower end of the shaft 30 is inserted into the hosel cavity 28 until the ferrule's lower end abuts against the upper end of the hosel 26. A slight gap remains between the lower end of the shaft 30 and the upper end of the hosel plug 36, such gap being filled with the adhesive material. The lower end of the shaft 30 preferably is plugged, to prevent the adhesive material from entering the shaft 30 during the installation procedure.

The hosel plugs 36 can be conveniently formed by mixing together tungsten powder and nylon, in their prescribed relative proportions, and then melting the mixture and extruding it into elongated rods. These rods then are chopped into smaller pieces and delivered to an injection molding machine, to produce plugs having the desired size and shape.

It should be appreciated from the foregoing description that the present invention provides an improved golf club, wherein a desired weight for the club's head can be precisely controlled. The desired head weight is provided by selecting one hosel plug from a group of such plugs having identical sizes but a range of weights, and by then installing the selected plug into a lower portion of a cavity defined in the club head's hosel. The shaft then is inserted into an upper portion of the hosel cavity, above the hosel plug. The plug is configured to have little effect on important club head parameters such as coefficient of restitution and center of gravity. The plug also is configured to remain in its installed position even if the club's shaft is removed and replaced. This is an important advantage, because shafts frequently need to be replaced due to damage or due to the golfer's desire to substitute a shaft having a different flex. The invention allows this replacement to be performed conveniently without affecting the club head's weight. The invention is applicable to golf clubs of all kinds, including metal woods, irons and putters.

Although the invention has been disclosed with reference only to the presently preferred embodiment, those skilled in the art will appreciate that various modifications can be made with departing from the invention. Accordingly, the invention is limited only by the following claims.

We claim:

1. A golf club comprising:

a head having a heel end, a toe end, and a ball-striking face, wherein the heel end includes a hosel that defines a generally cylindrical cavity;

a hosel plug sized to fit into a lower end of the hosel cavity; and a shaft having a lower end sized to fit into, and be secured to, the hosel cavity, at a location above the hosel plug;

wherein the hosel plug comprises a mixture of a metallic powder and a compliant polymeric material, in prescribed relative proportions, and wherein the hosel plug is sized to fit snugly into the lower end of the hosel cavity, where it is secured in place by compression of its compliant polymeric material.

2. A golf club as defined in claim 1, wherein:

the metallic powder of the hosel plug comprises tungsten; and the compliant polymeric material of the hosel plug comprises nylon.

3. A golf club as defined in claim 1, wherein the hosel plug has a substantially cylindrical shape.

4. A golf club as defined in claim 1, wherein:

the hosel cavity includes a lower cylindrical cavity having a first diameter and an upper cylindrical cavity having a second diameter, larger than the first diameter;

the hosel plug has a substantially cylindrical shape sized to fit snugly within the hosel's lower cylindrical cavity; and the lower end of the shaft has a substantially cylindrical shape sized to fit within the hosel's upper cylindrical cavity.

5. A golf club as defined in claim 4, wherein:

the hosel's lower cylindrical cavity has a diameter about 8.5 mm and a length of about 10 mm; and the hosel's upper cylindrical cavity has a diameter of about 9 mm and a length of about 25 mm.

6. A golf club as defined in claim 1, wherein the hosel plug has a mass in the range of about 0.5 g to at least about 6.5 g.

7. A golf club as defined in claim 1, wherein the hosel plug has a weight that constitutes between about 0.25% and at least about 3.25% of the club head's total weight.

8. A golf club as defined in claim 1, wherein the hosel plug is secured in place within the hosel cavity by slight compression of its compliant polymeric material and without need of deforming from its substantially cylindrical shape.

9. A method for making a golf club head having a desired weight, comprising:

forming a non-final golf club head having a heel end, a toe end, and a ball-striking face, wherein the heel end includes a hosel that defines a substantially cylindrical cavity having a lower portion and an upper portion;

providing a plurality of hosel plugs, each comprising a mixture of a metallic powder and a compliant polymeric material, in prescribed relative proportions, wherein the plurality of hosel plugs all have substantially the same size and shape and each are dimensioned to fit snugly into the lower portion of the substantially cylindrical cavity of the hosel, where it is secured in place by compression of its compliant polymeric material, and wherein the plurality of hosel plugs together have a range of weights;

selecting a particular one of the plurality of hosel plugs having a weight that will combine with the non-final golf club head to provide a desired total weight; and installing the selected hosel plug into the lower portion of the substantially cylindrical cavity of the hosel, to produce a final golf club head having the desired weight.

10. A method as defined in claim 9, wherein the plurality of hosel plugs range in mass from about 0.5 g to at least about 6.5 g.

11. A method as defined in claim 9, wherein the plurality of hosel plugs have weights that range from about 0.25% to at least about 3.25% of the combined weight of the plug and non-final golf club head.

12. A method as defined in claim 9, wherein:

the lower portion of the cylindrical cavity of the hosel formed in the step of forming has a first diameter and the upper portion of the cylindrical cavity formed in the step of forming has a second diameter, larger than the first diameter; and the plurality of hosel plugs are each dimensioned to fit snugly within, and to extend over the entire length of, the lower portion of the cylindrical cavity of the hosel.

13. A method as defined in claim 12, wherein the step of forming includes:

configuring the lower portion of the cylindrical cavity to have a diameter about 8.5 mm and a length of about 10 mm; and configuring the upper portion of the cylindrical cavity to have a diameter of about 9 mm and a length of about 25 mm.

14. A method as defined in claim 9, wherein:

the metallic powder of each of the plurality of hosel plugs provided in the step of providing comprises tungsten; and the compliant polymeric material of each of the plurality of hosel plugs provided in the step of providing comprises nylon.

15. A method as defined in claim 14, wherein the plurality of hosel plugs comprise tungsten in weight percentages ranging from about 0% to about 96%.

16. A method as defined in claim 9, wherein the plurality of hosel plugs all have a substantially cylindrical shape.

17. A method as defined in claim 9, wherein the hosel plug is secured in place within the hosel cavity by slight compression of its compliant polymeric material and without need of deforming from its substantially cylindrical shape.

18. A golf club comprising:

a head having a heel end, a toe end, and a ball-striking face, wherein the heel end defines a hosel that includes a lower cylindrical cavity having a first diameter and an upper cylindrical cavity having a second diameter, larger than the first diameter;

a substantially cylindrical hosel plug; and a shaft having a lower end sized to fit into, and be secured to, the upper cylindrical cavity of the hosel, above the hosel plug;

wherein the hosel plug comprises a mixture of a tungsten powder and nylon, in prescribed relative proportions;

wherein the hosel plug is sized to fit snugly into the lower cylindrical cavity of the hosel, where it is secured in place by compression of its compliant polymeric material;

and wherein the hosel plug has a weight that constitutes between about 0.25% and at least about 3.25% of the club head's total weight.

19. A golf club as defined in claim 18, wherein the hosel plug is secured in place within the hosel cavity by slight compression of its compliant polymeric material and without need of deforming from its substantially cylindrical shape.

* * * * *